US006027437A

United States Patent [19]

Vercelli et al.

[11] Patent Number: 6,027,437

[45] Date of Patent: Feb. 22, 2000

[54] METHOD OF PRODUCING A PACKAGE, PARTICULARLY FOR PACKAGING PRODUCTS, AND PACKAGE FORMED USING SUCH A METHOD

[75] Inventors: Luigino Vercelli; Giuseppe Rispoli, both of Pino Torinese, Italy

[73] Assignee: Paros S. R. L., Torino, Italy

[21] Appl. No.: 09/040,855

[22] Filed: Mar. 18, 1998

[30] Foreign Application Priority Data

Mar. 21, 1997 [IT] Italy ..... TO97A0238

[51] Int. Cl.[7] ..... B65D 85/34

[52] U.S. Cl. ..... 493/85; 493/339; 220/4.21; 53/138.2

[58] Field of Search ..... 493/85, 115, 338, 493/339; 53/138.2, 139.2, 453, 559, 561; 220/4.21, 324, 326, 690, 720

[56] References Cited

FOREIGN PATENT DOCUMENTS 1582604 10/1969 France .

598113 6/1934 Germany .

9535204 12/1995 WIPO .

OTHER PUBLICATIONS

English abstract of FR 1,582,604 of Oct. 1969.

*Primary Examiner*—David A. Scherbel
*Assistant Examiner*—Anthony Ojini
*Attorney, Agent, or Firm*—Ladas & Parry

[57] ABSTRACT

A method of producing a package, particularly for packaging products, the method including the steps of feeding a sheet material to a forming die; deforming and cutting the sheet material to obtain a hollow semifinished body of revolution having at least one inlet opening; forming, on an edge of the semifinished body, two localized bends on opposite sides of the opening and aligned with each other along an axis; permanently deforming the semifinished body by rotating two portions of the semifinished body, located on opposite sides of the axis, about the axis to form an elongated body in a stable, at least partly-open condition, and which may be brought manually into an unstable closed condition in which it is maintained by a releasable retaining device.

22 Claims, 2 Drawing Sheets

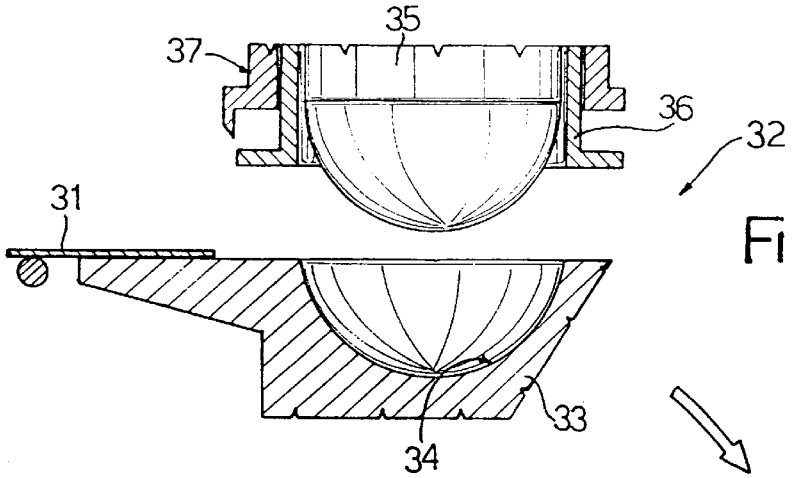
Fig.9
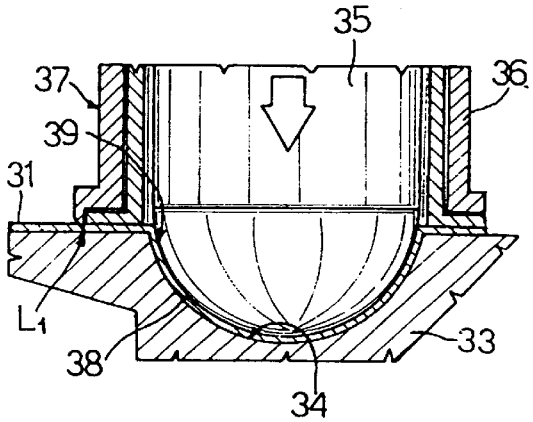
Fig.10
Fig.11
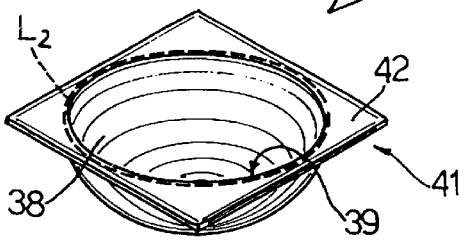
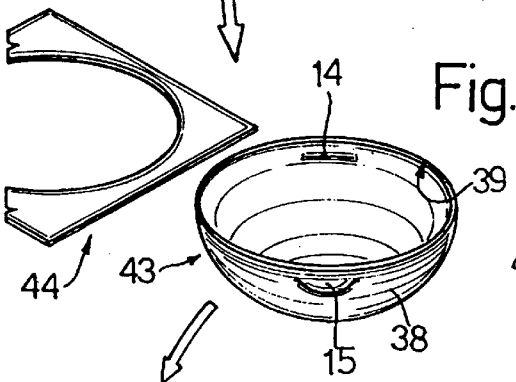
Fig.12
Fig. 14
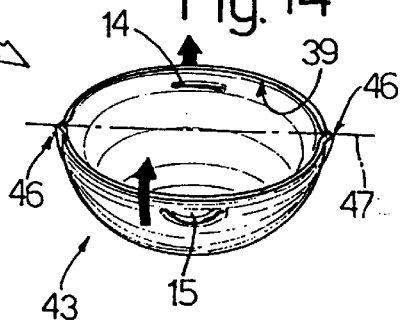
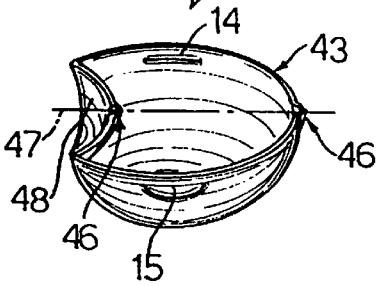
Fig.13

METHOD OF PRODUCING A PACKAGE, PARTICULARLY FOR PACKAGING PRODUCTS, AND PACKAGE FORMED USING SUCH A METHOD

BACKGROUND OF THE INVENTION

The present invention relates to a method of producing a package, particularly but not exclusively for packaging products.

Products in general are packaged in packages or containers formed by first forming a flat blank having a number of cuts defining a number of panels and tabs; folding the panels and tabs, normally along preformed bend lines; and then connecting the panels and tabs firmly to one another by inserting the tabs, for example, inside corresponding slits formed on the panels or other tabs, or by gumming the various parts together.

Though widely used, known packages of the type described above are fairly expensive and time-consuming to produce, mainly on account of the complex design of both the blanks themselves and the machinery for producing and folding them.

Moreover, at least some known packages also fail to maintain their shape adequately, due to the large number of cuts, preformed bend lines, and points or portions connecting the various parts of the blank, which inevitably result, in time, in relative movement of the various component parts, and in a gradual, noticeable impairment in the original appearance of the package.

SUMMARY OF THE INVENTION

It is an object of the present invention to provide a method of producing a package, particularly for packaging products, designed to overcome the aforementioned drawbacks.

According to the present invention, there is provided a method of producing a package, particularly for packaging products, characterized by comprising the steps of feeding a sheet material to a forming station; permanently deforming said sheet material to form a hollow portion; cutting said sheet material to form a hollow semifinished body having at least one inlet opening; forming on said hollow semifinished body two localized bends on opposite sides of said opening and aligned with each other along an axis; and permanently deforming said semifinished body by rotating two portions of the semifinished body, located on opposite sides of said axis, about the axis to form a body in a stable, partly-open configuration.

The present invention also relates to a package, particularly for packaging products.

According to the present invention, there is also provided a package, particularly for packaging products, characterized by comprising an elongated body having an axis and formed from a single piece of permanently deformable sheet material; the body comprising two concave portions defining at least one inlet opening and movable, with respect to each other and about said axis, between a parted position corresponding to a stable open configuration of the body, and a mating position corresponding to an unstable closed configuration of the body; releasable retaining means being provided to maintain said body in said unstable closed configuration.

BRIEF DESCRIPTION OF THE DRAWINGS

A number of non-limiting embodiments of the present invention will be described by way of example with reference to the accompanying drawings, in which:

FIGS. 9 to 14 show, schematically, a succession of steps in the formation of the package according to the present invention.

DETAILED DESCRIPTION OF THE INVENTION

Figure 1:
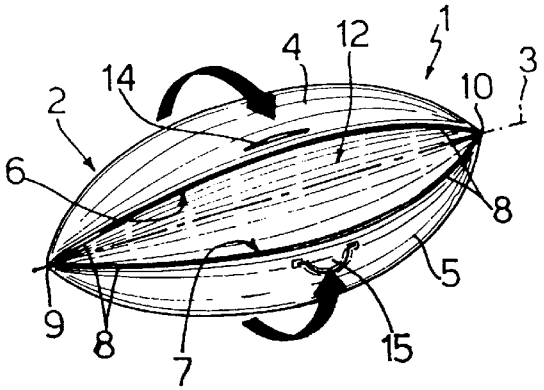
FIGS. 1 and 2 show views in perspective, and in two different operating positions, of a first preferred embodiment of the package according to the teachings of the present invention.
Figure 2:
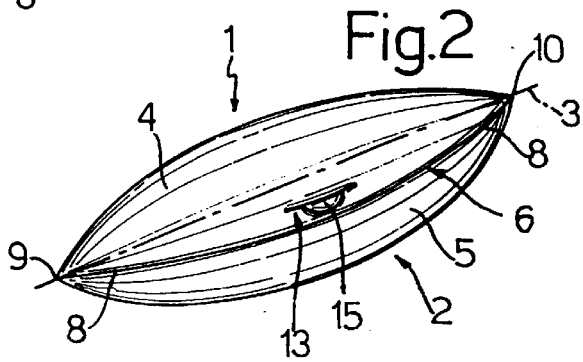

Number 1 in FIGS. 1 and 2 indicates a tapering package conveniently, but not exclusively, for packaging articles, preferably gift items. Package 1 comprises an elongated body 2 having a respective longitudinal axis 3, and which is preferably made of thermoplastic material, or of ordinary paper material possibly covered with sheets of plastic material. Body 2 is also conveniently made of leather or highly deformable metal material such as aluminum or copper.

Still with reference to FIGS. 1 and 2, body 2 comprises two convex elongated portions 4 and 5 located on opposite sides of axis 3 with respective concavities facing each other. Portions 4 and 5 are integral with each other, and have respective curved free end edges 6, 7, the end portions 8 of which converge at two points 9 and 10 spaced apart along axis 3 and defining the opposite vertices of body 2. In use, portions 4 and 5 rotate, with respect to each other and about axis 3, between a parted position corresponding to a stable open condition of body 2 (FIG. 1) in which respective edges 6, 7 define an inlet opening 12 of body 2, and a mating position corresponding to a closed condition of body 2 (FIG. 2) in which edge 6 of portion 4 extends and is superimposed on an intermediate portion of portion 5.

Still with reference to FIGS. 1 and 2, package 1 also comprises a releasable retaining device 13 for maintaining body 2 in the closed position, and which in turn comprises a slit 14 formed in portion 4, and a tab 15 formed in portion 5 and insertable through slit 14.

Figure 3:
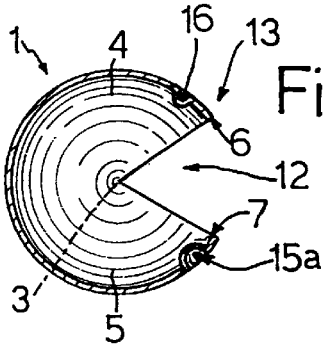
FIGS. 3 to 6 show three variations of a detail in FIGS. 1 and 2.

Alternatively, as shown in FIG. 3, device 13 comprises a cavity or seat 15*a* formed by permanently deforming a portion of portion 5, close to edge 7; and a projection 16 formed by permanently deforming portion 4, and which clicks inside seat 15*a*.

Figure 4:
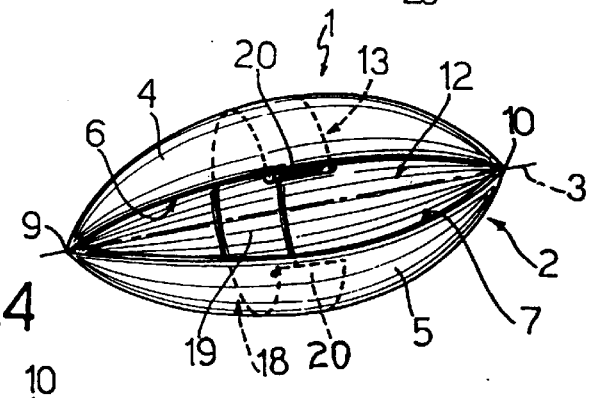

As shown in FIG. 4, device 13 comprises a curved blade element 18, in turn comprising an intermediate portion 19 extending in contact with an inner surface of body 2 and connected, conveniently glued, integrally to body 2, and two shaped end portions 20 which are mutually engaged/released when portions 4 and 5 are rotated between said parted and mating positions. In a variation not shown, at least portion 19 of element 18 extends in contact with an outer surface of body 2. In both cases, intermediate portion 19 is elastically deformable and so formed as, in use, to move portions 4 and 5 into the parted position and body 2 into the open position.

Figure 5:
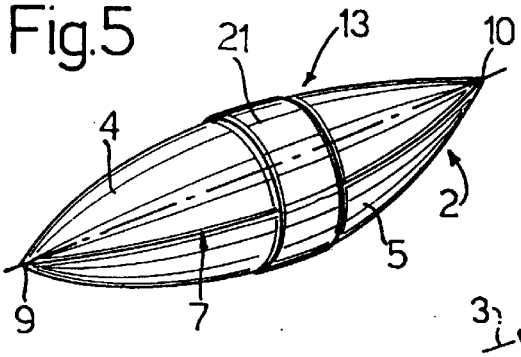

As shown in FIG. 5, device 13 comprises a straightforward annular element 21 preferably made of sheet material, and which is fitted on to body 2 when portions 4 and 5 are substantially in the mating position.

Figure 6:
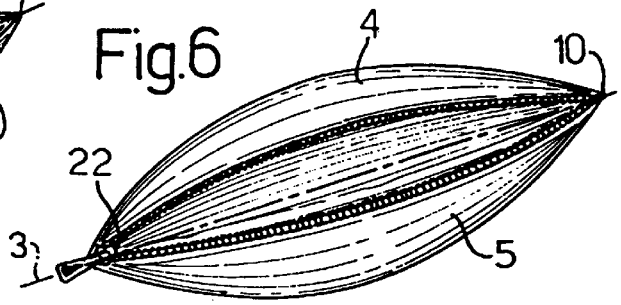

As shown in FIG. 6, device 13 comprises a toothed or railed zipper 22.

Figure 7:
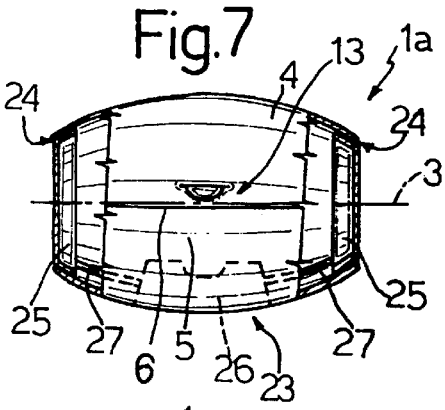
FIG. 7 shows a view in perspective of a second preferred embodiment of the package according to the present invention.

The FIG. 7 embodiment shows a package 1*a* similar to package 1, and the component parts of which are indicated, where possible, using the same numbering system as for the corresponding parts of package 1.

Package 1*a* comprises a body 23, which only differs from body 2 by comprising two openings 24 facing each other coaxially with axis 3, and closed by respective cover elements 25. Elements 25 are made of the same material as body 23, or of transparent or opaque materials, and are fitted directly to body 23 in known manner (not shown), e.g. by means of an appendix, or are fitted by means of flexible, relatively movable plate elements 27 to an element 26 supporting an article housed inside body 23.

Figure 8:
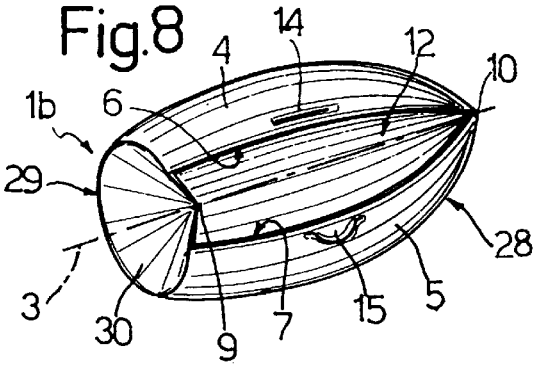
FIG. 8 shows a view in perspective of a third preferred embodiment of the package according to the present invention.

The FIG. 8 embodiment shows a package 1*b* similar to package 1, and the component parts of which are indicated, where possible, using the same numbering system as for the corresponding parts of package 1.

Package 1*b* comprises a body 28, which only differs from body 2 by the vertex coincident with point 9 again lying along axis 3 but being located inside body 28. Body 28 is therefore defined longitudinally by an edge 29, which defines a support for body 28 and lies in a plane substantially perpendicular to axis 3, and from which extends inwards of body 28 a tapered hollow portion 30 with its concavity facing outwards.

With reference to FIGS. 9 to 14, package 1 is formed from a flexible sheet material, conveniently a strip 31, which is fed in known manner to a forming station housing a known stamping tool 32, which, in the example described, comprises a bottom die 33 defining a substantially hemispherical cavity 34, a top punch 35 movable to and from cavity 34, a strip-holder 36, and a cutting unit 37 shown only partly.

An end portion of strip 31 positioned on die 33 is held on die 33 by strip-holder 36; and, at the same time, punch 35 is lowered to permanently deform the portion inside cavity 34 to form a hollow hemispherical bowl 38 (FIG. 11) having an inlet opening 39. Cutting unit 37 then makes a first cut of strip 31 along a cutting line L1 (FIG. 10), e.g. substantially crosswise to the traveling direction of strip 31, to form a body 41 (FIG. 11) comprising, in addition to hemispherical bowl 38, an outer flange 42 extending from an outer edge of hemispherical bowl 38. A known cutting unit (not shown) then makes a second cut along a closed cutting line L2 substantially coincident with an outer edge of hemispherical bowl 38, to form a first hemispherical hollow blank 43 (FIG. 12) and a second flat annular blank 44. Simultaneously with the second cut, a further two cuts are made in diametrically-opposed portions of bowl 38—eventually defining portions 4 and 5—to form slit 14 and tab 15.

At this point, two localized bends 46 are formed on the edge of hemispherical blank 43, along a diametrical axis 47 of blank 43, and which eventually define the vertices of body 2; and blank 43 is then permanently deformed further by rotating the portions in which slit 14 and tab 15 are formed in relation to each other and about axis 47 to obtain body 2 in the stable open position (FIG. 1) and with its own axis 3 coincident with axis 47.

At this point, by simply exerting manual pressure on portions 4 and 5 of body 2 to rotate portions 4 and 5 further about axis 3, 47, body 2 may be set to the closed position in which portions 4 and 5 overlap, and tab 15 positively engages slit 14. Tab 15 is released from slit 14, and hence package 1 opened, by rotating portions 4 and 5 further and in the same direction as before about axis 3, 47, and then releasing them to allow body 2 to return automatically to the open position.

Blank 44, on the other hand, is deformed and possibly cut again to form a supporting element for body 2, or to form element 26.

In the event retaining device 13 comprises seat 15*a* and projection 16 (FIG. 3), a permanent deformation operation, conveniently a drawing operation, is substituted for said further cuts.

In the event device 13 comprises element 18 or 21, said further cuts and said permanent deformation operation are dispensed with, the preformed element 18 is glued to the surface of body 2 in the open position, and element 21 is simply fitted on to body 2 in the closed position.

Package 1*a* is formed in the same way as package 1, except for comprising the further step of removing both the end portions of body 2 close to the vertices to form the two openings 24 coaxial with axis 3, each of which is then closed by a respective cover element 25.

The formation of package 1*b*, on the other hand, differs from that of package 1 by comprising the further operation of folding a portion of blank 43, not affected by the cuts to form tab 15 and slit 14, towards a diametrically-opposed portion of blank 43 to form an outwardly-open hollow portion 48, on the edge of which one of said bends 46 is subsequently formed.

Packages 1, 1*a*, 1*b* as described therefore comprise respective bodies 2, 23, 28, each formed from a flat blank of sheet material, and each having no cuts or preformed bend lines. Bodies 2 and 23 are even formed in one piece. Unlike known packages, packages 1, 1*a*, 1*b* therefore maintain not only their original configuration but also, and above all, their original appearance.

Packages 1, 1*a*, 1*b* as described are therefore extremely easy to produce, can all be produced on commonly used tools, and are therefore extremely cheap to make, while at the same time maintaining a high standard of appearance.

Clearly, changes may be made to packages 1, 1*a*, 1*b* as described herein without, however, departing from the scope of the present invention. In particular, the form of bodies 2, 23, 28 may differ from those described by way of example. The final shape in fact of bodies 2, 23, 28 is a direct result of the shape of hollow blank 43, which may differ in form and shape from those described, and, in particular, may comprise a number of different integral hollow bodies of revolution. The shape of blank 43 in fact obviously depends exclusively on the shape of punch 35 and cavity 34.

Packages 1, 1*a*, 1*b* as described may obviously comprise retaining devices, for maintaining respective bodies 2, 23, 28 in the closed position, other than those described by way of example, and may also comprise gripping means, such as one or more rigid or flexible handles.

Packages 1, 1*a*, 1*b* as described may obviously be used for applications other than that described by way of example. In particular, as opposed to being used singly, the packages may be used in combination with other, not necessarily similar, packages; for which purpose, each package may comprise connecting elements for connection to other packages and located, for example, close to the vertices of the respective body.

Finally, each package 1, 1*a*, 1*b* may comprise at least one hanger element by which to hang the package to a respective supporting element. In particular, the hanger element may comprise a first elongated portion, e.g. a cord or chain, and a second fastening portion housed at least partly inside the respective body.

We claim:

1. A method of producing a package (1; 1*a*; 1*b*), comprising the steps of feeding a sheet material (31) to deforming said sheet material (31) to form a hollow portion (38); cutting said sheet material (31) to form a hollow semifinished body (41; 43) having at least one inlet opening (39); forming on said hollow semifinished body (41; 43) two localized bends (46) on opposite sides of said opening (39) and aligned with each other along an axis (47); and permanently deforming said semifinished body (41; 43) by rotating two portions of the semifinished body (41; 43), located on opposite sides of said axis (47), about the axis (47) to form a body (2; 23; 28) in a stable, partly-open configuration.

2. A method as claimed in claim 1, comprising the further step of forming a retaining device (13) for maintaining said body (2; 23; 28) in an unstable configuration in which said opening (39) is at least partly closed.

3. A method as claimed in claim 2, wherein the formation of said retaining device (13) comprises the steps of forming, on each said portion of said hollow semifinished body (43), a respective cut along a respective cutting line to form, on said body (2; 23; 28), at least a tab (15) and at least a seat (14) positively engageable by said tab (15).

4. A method as claimed in claim 2, wherein the formation of said retaining device (13) comprises the steps of deforming at least one portion of one of said portions to form a retaining seat (15*a*), and at least one portion of the other of said portions to form a projection (16) for positively engaging said retaining seat (15*a*).

5. A method as claimed in claim 2, wherein the formation of said retaining device (13) comprises the steps of fitting said body (2; 23; 28) with a retaining element (18) having end portions (20) positively engaging each other in releasable manner.

6. A method as claimed in claim 2, wherein the formation of said retaining device (13) comprises the steps of forming an annular element (21), and fitting the annular element (21) on to the body (2; 23; 28) when the body (2; 23; 28) is in a condition close to said at least partly-closed configuration.

7. A method as claimed in claim 1, wherein said cutting step comprises at least one cutting operation along a first cutting line (L2) substantially coincident with an edge defining said opening (39), so as to form a hollow body of revolution (43).

8. A method as claimed in claim 7, wherein said bends (46) are formed on said edge.

9. A method as claimed in claim 7, wherein said cutting operation comprises a second cutting operation to cut said sheet material (31) along a second cutting line (L1), at a distance from said first cutting line (L2), to form a blank (44) by which to define a supporting element for said body (2; 23; 28).

10. A method as claimed in claim 1, wherein said cutting operation comprises a third cutting operation to form at least one opening (24) through which, when formation is complete, said axis (47) extends.

11. A method as claimed in claim 1, comprising the further step of deforming one portion (48) of said semifinished body (43), through which said axis (47) extends when formation is complete, towards an opposite portion of the semifinished body (43), through which said axis (47) also extends, so as to form on said body (2; 23; 28) an outwardly-open cavity having an inlet opening defined by a respective annular edge (29).

12. A package, comprising an elongated body of revolution (2; 23; 28) having an axis (3) and formed from a single piece of permanently deformable sheet material; the body (2; 23; 28) comprising two concave portions (4) (5) defining at least one inlet opening (12) and movable, with respect to each other and about said axis (3), between a parted position corresponding to a stable open configuration of the body (2; 23; 28), and a mating position corresponding to an unstable closed configuration of the body (2; 23; 28); releasable retaining means (13) being provided to maintain said body (2; 23; 28) in said unstable closed configuration.

13. A package as claimed in claim 12, also comprising at least a further inlet opening (24) through which said axis (3) extends.

14. A package as claimed in claim 13, comprising closing means (25) for closing said further opening (24); and connecting means (27) for connecting said closing means (25) to said body (2; 23; 28).

15. A package as claimed in claim 12, wherein said retaining means (13) comprise a first retaining element (15; 16) carried by one of said portions (4) (5); and a retaining seat (14; 15*a*) formed on the other of said portions (4) (5) and positively engaged in releasable manner by said retaining element (15; 16).

16. A package as claimed in claim 12, wherein said retaining means (13) comprise at least a curved blade element (18) fitted to said body (2; 23; 28); first and second connecting means (20) being provided to releasably connect opposite end portions of said curved blade element (18).

17. A package as claimed in claim 16, wherein said curved blade element (18) comprises at least an elastic intermediate portion (19), which, in use, provides for moving the body (2; 23; 28) into the stable open configuration.

18. A package as claimed in claim 12, wherein said retaining means (13) comprise at least an annular element (21) fitted to the body (2; 23; 28).

19. A package as claimed in claim 12, wherein said body (2; 23; 28) is made of thermoplastic material.

20. A method for producing a package comprising the steps of:

(a) forming a single sheet of material into a hollow body having a longitudinal axis and integral first and second concave portions disposed with respect to one another in a first or open position with respective edges of the first and second concave portions spaced from one another to define an inlet opening of the body, said material being sufficiently elastic such that (i) upon exertion of pressure, the first and second concave portions are movable about said axis with respect to one another from said first or open position to a second or closed position with the respective edges of the first and second concave portions abutting one another whereby to close the inlet opening and (ii) upon release of the pressure, the first and second concave portions return to said first or open position; and (b) providing the hollow body with retaining means for releasably retaining the first and second concave portions in said second or closed position, said first and second concave portions returning to said first or open position upon a release of said retaining means.

21. A method as claimed in claim 20 wherein said forming step (a) comprises the steps of:

(i) deforming the single sheet of material to form a hollow portion therein;

(ii) cutting the deformed sheet material to form a hollow blank that is hemispherical in shape, said hollow blank having an opening;

(iii) deforming the hollow blank to form first and second localized bends disposed on opposite sides of the opening of the hollow blank and aligned with each other along said axis;

(iv) deforming the blank by rotating portions thereof in relation to one another and about said axis to form said hollow body having said first and concave portions in said first or open position.

22. A package formed by the method of claim 20, that is ellipsoid or frustoellipsoid in shape.

* * * * *